US007359659B2

(12) United States Patent
Sakai et al.

(10) Patent No.: US 7,359,659 B2
(45) Date of Patent: Apr. 15, 2008

(54) IMAGE FORMING APPARATUS AND IMAGE FORMING METHOD TO CREATE A COMPOSITE IMAGE OF A PAGE IMAGE AND AN INPUT TEXT STRING

(75) Inventors: Takaaki Sakai, Hachioji (JP); Masaru Ushio, Hachioji (JP); Katsutoshi Iwai, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 60 days.

(21) Appl. No.: 11/396,219

(22) Filed: Mar. 31, 2006

(65) Prior Publication Data

US 2007/0014590 A1 Jan. 18, 2007

(30) Foreign Application Priority Data

Jul. 12, 2005 (JP) ..... 2005-203284

(51) Int. Cl.
*G03G 15/36* (2006.01)
*G03G 15/00* (2006.01)

(52) U.S. Cl. ..... 399/194; 399/6

(58) Field of Classification Search ..... 399/6, 399/82, 194
See application file for complete search history.

(56) References Cited

U.S. PATENT DOCUMENTS 5,030,995 A * 7/1991 Bolton ..... 399/194
5,331,375 A * 7/1994 Ito ..... 399/6
5,386,270 A * 1/1995 Housel ..... 399/6
5,742,881 A * 4/1998 McTigue ..... 399/194
5,819,143 A * 10/1998 Sakai et al. ..... 399/194

* cited by examiner

*Primary Examiner*—Sandra L. Brase
(74) *Attorney, Agent, or Firm*—Frishauf, Holtz, Goodman & Chick, P.C.

(57) ABSTRACT

An image forming apparatus includes a dividing section which divides a plurality of pages into groups, each group including at least one page; an inputting section which inputs different text strings for each group; a creating section which creates a composite image of an image of a page and a text string which is inputted for the group including the page; and a printing section which prints the composite image on a sheet.

20 Claims, 13 Drawing Sheets

IMAGE FORMING APPARATUS AND IMAGE FORMING METHOD TO CREATE A COMPOSITE IMAGE OF A PAGE IMAGE AND AN INPUT TEXT STRING

TECHNICAL FIELD

This application is based on Japanese Patent Application No. 2005-203284 filed on Jul. 12, 2005, in Japanese Patent Office, the entire content of which is hereby incorporated by reference.

BACKGROUND

The invention relates to an image forming apparatus.

Conventionally, an image forming apparatus such as a copier which image-forms on the recording sheet based on the image data is carried out. Further, as the image forming apparatus, an apparatus having a group-dividing function is investigated.

Referring to FIG. 12, the group-dividing function will be described. In FIG. 12, the recording sheets a31-a36 which is image-formed by the group-dividing function are shown.

The chapter is a collection formed of one or a plurality of image data. It is defined that the group dividing function is a function that, when the image data is double side image formed in order on the recording sheet, the image data of the first page of the chapter is image formed. on the surface. Further, when the last page of the chapter is image formed on the surface of the recording sheet, the white image data (NULL data) is added as the next image data, and on its rear surface, the white images data is image formed (the image data is not image formed).

For example, as shown in FIG. 12, the case where the image data A1-A3 are the first chapter, the image data A4-A8 are second chapter, the image data A9, A10 are the third chapter, and the image data A1-A10 are chapter-divided in order on the recording sheets a31-a36 and image formed, will be described.

In the first chapter, in the recording sheet a31, the image data Al is image formed on the surface b31, and the image data A2 is image formed on the rear surface c31. In the recording sheet a32, the image data A3 is image formed on the surface b32, and because the image data A4 is on the top page of the second chapter, the image data is not image formed on the rear surface c32.

In the same manner, in the second chapter, in the recording sheets a33-a35, the image data A4-A8 are image formed in order on the surface b33, the rear surface c34-surface b35, and on the rear surface c35, the image data is not image formed. In the same manner, in the third chapter, in the recording sheet a36, the image data A9, A10 are image formed in order on the surface b36, the rear surface c36.

Further, in the image forming apparatus having the group-dividing function, an apparatus having a function by which, together with the image data, the chapter number and the chapter page number are image formed, is considered (for example, Japanese Unexamined Patent Publication No. 2001-274977).

Referring to FIG. 13, in the image forming apparatus, the conventional third image forming processing by which the chapter number and the chapter page number are image-formed, will be described. In FIG. 13, a flow of the third image forming process is shown. The chapter number is a number by which each chapter is identified. The chapter page number is a page number for each chapter, and it is distinguished from the all-page number as the page number of the whole.

In the image forming apparatus, initially, it is inputted through an operation section from the user. The image formation position information of the chapter number and the chapter page number is received, and based on the position information, the image formation position of the chapter number and the chapter page number is set (step S51). Then, the letter size information of the chapter number and the chapter page number inputted through the operation section from the user, is received, and based on the letter size information, the letter size of the chapter number and the chapter page number is set.(step S52).

Then, the chapter diving designation page number information which is inputted through the operation section by the user, and is the top page of each chapter is received, and based on the page number information, the chapter dividing designation page number is set (step S53). Then, it is discriminated whether each kind of setting by the operation inputs are completed (step S54). When each kind of setting is not completed (step S54; NO), the sequence advances to step S51. When each kind of setting is completed (step S54; YES), the whole page number counter and the chapter page number counter are set to 0 (step S55). Then, the chapter number counter is set to 0 (step S56).

Then, the total page number counter is incremented (step S57). Then, it is discriminated whether the total page number of the total page number counter is the chapter dividing designation page number (step S58). When it is the chapter designation number (step S58; YES), the chapter page number counter is set in such a manner that the chapter page number=1 (step S59).

Then, the chapter number counter is incremented by 1 and set (step S60). Then, in the image data which is next image formed, in the position and the letter size set in steps S51, and S52, the chapter number and the chapter page number of the chapter number counter and the chapter page number counter are compounded as the image, and the composite image for the 1 page is image formed on the next surface of the recording sheet (step S61). The next surface of the recording sheet is, in the chapter page designation page, the surface of the next recording sheet, and in the other cases, the next surface or the rear surface of the image formed surface.

When it is not the chapter dividing designation page number (step S58; NO), the chapter page number counter is incremented by 1 and set (step S62) and the sequence advances to step S61.

Then, by step S61, it is judged whether the total pages are image formed (step S63), and when the all pages are not images formed (step S63; NO), the sequence advances to step S57. When all pages are image formed (step S63; YES), the third image formation processing is completed.

Referring to FIG. 14, an example of the image formation of the chapter number and the chapter page number by the third image formation processing will be described bellow. In FIG. 14, the recording sheets a41-a46 on which, together with the image data, the chapter number and the chapter page number are image formed will be shown.

The chapter-dividing in FIG. 14 is defined as the same as the example in FIG. 12. In the first chapter, in the recording sheet a41, on the surface b41, the image data A1, the chapter number and the chapter page number f1 are image formed, and on the rear surface c41, the image data A2, the chapter number and the chapter page number f2 are image formed.

The chapter number and the chapter page number are expressed in the form of "the chapter number—the chapter page number". In the recording sheet a42, on the surface b42, the image data A3, the chapter number, and the chapter page number f3 are image formed, and on the rear surface c42, the image data, the chapter number and the chapter page number are not image formed.

In the same manner, in the second chapter, in the recording sheets a43-a45, on the surface b43, the rear surface c43—the surface b45, the image data A4-A8, the chapter number and the chapter page numbers f4-f8 are image formed in order, and on the rear surface c45, the image data, the chapter number and the chapter page number are not image formed. In the same manner, in the third chapter, in the recording sheet a46, on the surface b46, the rear surface c46, the image data A9, A9,A10, the chapter number and the chapter page numbers f9 and f10 are image formed in order.

However, in the image forming apparatus having the conventional group-dividing function, together with the image data, the text string except of the chapter number and the chapter page number can not be image formed.

SUMMARY

An object of the present invention is to image form the text string except of the number, together with the image data.

In order to attain the object, an image forming apparatus comprises a dividing section which divides a plurality of pages into some groups, each of which includes at least one page; an inputting section which inputs different text strings for each group; a creating section which creates a composite image of a page image and a text string which is inputted for the group including the page; and a printing section which prints the composite image on a sheet.

Further, the image forming apparatus of the present invention comprises, a dividing section which divides a plurality of pages into some groups, each of which includes at least one page; a memory which stores a text string stores different text strings for different group; a creating section which creates a composite image of a page image and the text string which is stored the memory for the group including the page; and a printing section which prints the composite image on a sheet.

BRIEF DESCRIPTION OF THE DRAWINGS

FIG. 6(*b*) is a view showing an applied function operation image plane 220.

FIG. 6(*c*) is a view showing a chapter dividing designation page number input image plane 230.

FIG. 7(*b*) is a view showing a chapter title information input image plane 250.

FIG. 7(*c*) is a view showing a chapter dividing designation page number input image plane 230*a*.

DESCRIPTION OF THE PREFERRED EMBODIMENT

Figure 1:
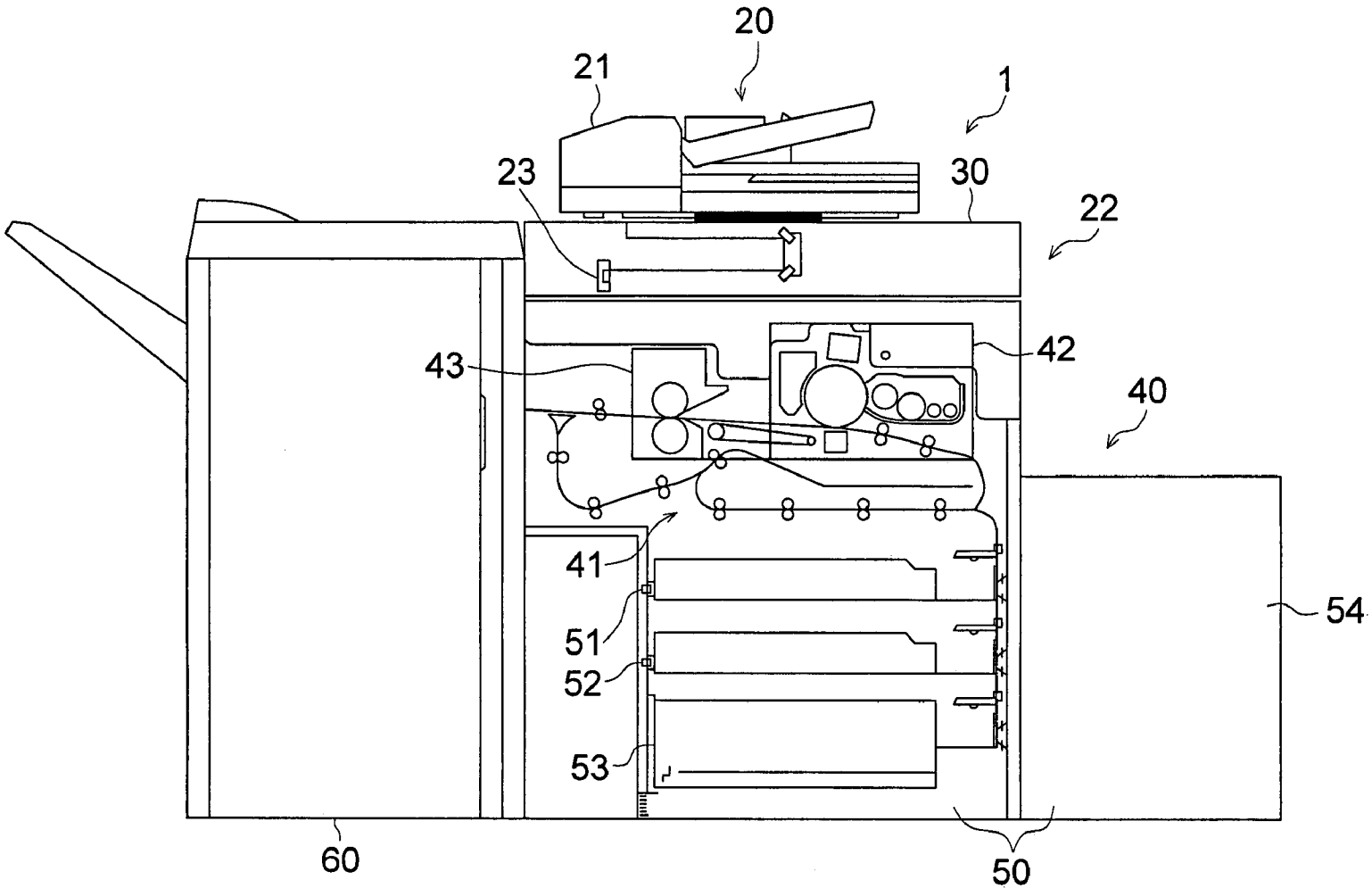
FIG. 1 is a view showing the structure of a copier 1 of the embodiment according to the present invention.

Referring to the drawings, the embodiment according to the present invention and its modification example will be described in order below. However, the scope of the invention is not limited to the illustrated example.

Figure 2:
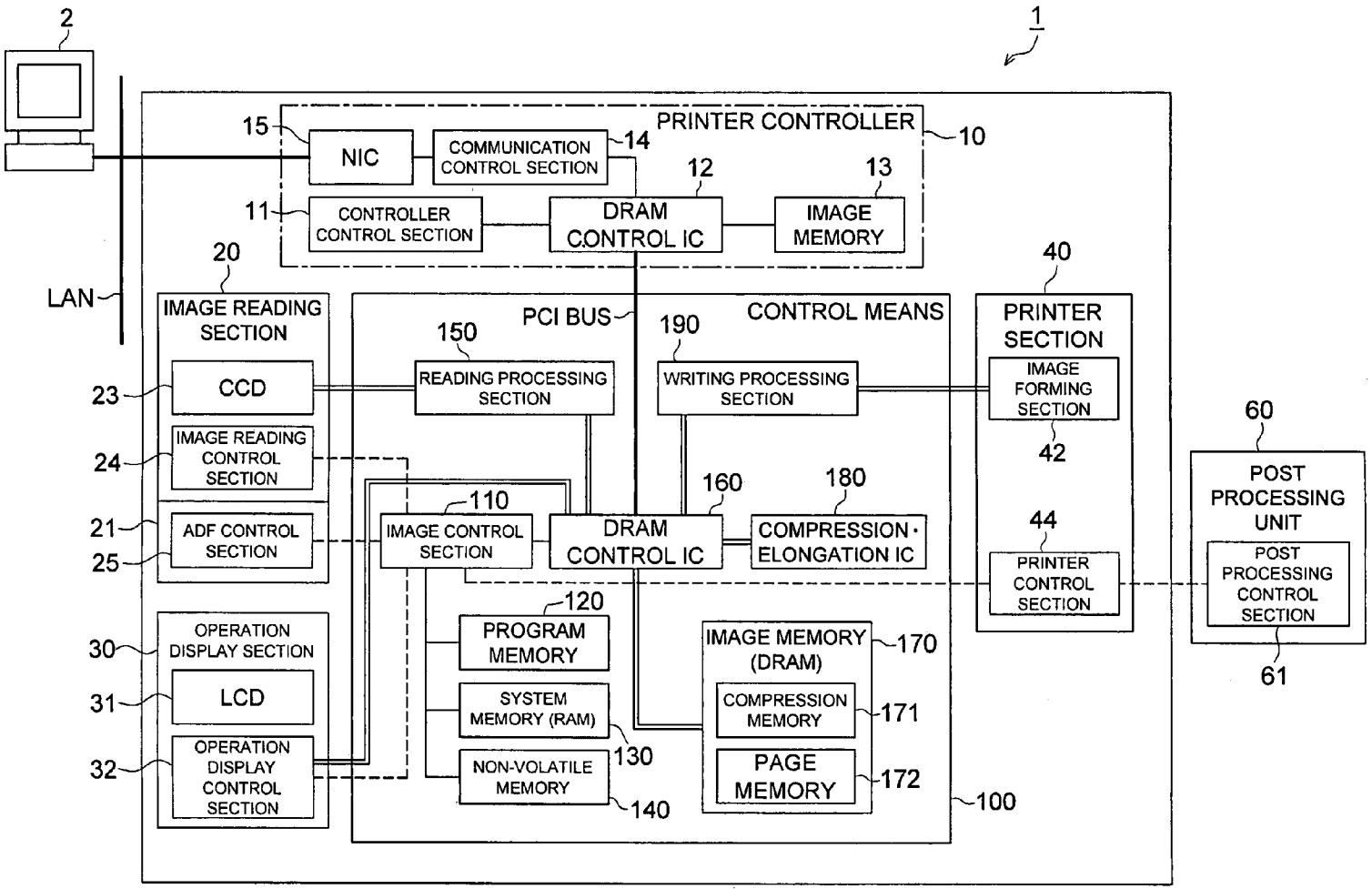
FIG. 2 is a block diagram showing an internal structure of the copier 1.

Referring to FIG. 1 and FIG. 2, initially, the feature of the apparatus of the present embodiment will be described. In FIG. 1, the structure of a copier 1 of the present embodiment is shown. In FIG. 2, the internal structure of the copier 1 is shown.

Initially, referring to FIG. 1, the copier 1 as the image forming apparatus of the present embodiment will be described. As shown in FIG. 1, the copier 1 is structured being provided with an image reading section 20, setting means, input means, operation display section 30 as a selection means, printer section 40 as the image forming means, sheet feed unit 50, and post processing unit 60.

Hereupon, in the present embodiment, the structure using the copier is described as the image forming apparatus, however, the invention is not limited to this, and as the image forming apparatus, it may also use the apparatus having at least the image forming function such as a printer.

The image reading section 20 is structured being provided with ADF (Auto Document Feeder) section 21 which is an automatic sheet feed mechanism, scanner section 22. The ADF section 21 carries the document placed on the document table. The scanner section 22 light-scans the document carried by the ADF section 21 through a contact glass, or light-scans the document placed on the platen glass, photoelectric converts by a CCD (Charge-Coupled Device) image sensor 23, and reads the image recorded in the document image and obtains the document image data.

On the document image data read by the image reading section 20, each kind of image processing is conducted by a control means 100 which will be described later, and as the image data for printing, it is outputted to the printer section 40, or stored in the image memory 170.

The operation display section 30 is provided with each kind of function key such as a numeral key, start key for indicating the print start, utility key, and the inputs of the user are received, and the input information is outputted to the control means 100. The operation display section 30 is provided with an LCD (Liquid Crystal Display) 31, and on the LCD 31, a touch panel which receives a touch input on the image screen, is structured, and each kind of operation image screen such as the setting image screen of the setting condition, or each kind of processing result are displayed.

The printer section 40 conducts the electronic-photographic type image formation, and has the double-side image formation function, and is structured being provided with a conveying mechanism 41 which conveys the recording sheet fed from the sheet feed unit 50, the image forming section 42 by which the image is formed on the recording sheet, and a fixing section 43 by which the toner image formed on the recording sheet is fixed. Further, the image forming section 42 is structured being provided with a photoreceptor drum which is an image career, a charging section for charging the photoreceptor drum, an exposing section such as an LD (Laser Diode) by which the photoreceptor drum surface are exposing-scanned based on the image data, a developing section for adhering the toner to the photoreceptor drum, a transfer section by which the toner image formed on the photoreceptor drum is transferred onto the recording sheet, and a cleaning section by which the remaining toner on the photoreceptor drum is removed.

The conveying mechanism 41 conveys the recording sheet taken out of the sheet feed unit 50 to the image forming section 42. Further, the conveying mechanism 41 has a reversing function of the recording sheet to the image forming section 42. When double-side image formation is conducted, the conveying mechanism 41 reverses the recording sheet whose one—surface is image formed by the image forming section 42, and conveys it again to the image forming section 42. The image forming section 42 image forms another surface of the recording sheet whose one surface is image formed, delivers it and double-side image forms. Hereupon, in the present embodiment, it is described that the printer section 40 conducts the electronic-photographing type image formation, however, it is not limited to that, but may also be applied by the other image forming system such as an inkjet system, thermal transferring system, the dot impact system.

The sheet feed unit 50 is structured being provided with 4 sheet feed trays of sheet feed trays 51-54. Hereupon, in the present embodiment, 4 sheet feed trays is provided, however, it is not limited to this, the number of that is not particularly limited. In each of sheet feed trays 51-54, the recording sheets whose kind of sheets and sizes such as the plain paper, rear paper, recycled paper, high quality paper, are different, can be accommodated.

The post processing unit 60 can conducts each kind of the post processing such as a sort processing, punch (punching) processing, staple processing, center folding processing, cut processing, and can make a booklet or a book.

Referring to FIG. 2, an internal structure of the copier 1 will be described. The copier 1 is structured being provided with a control means 100, printer controller 10, image reading section 20, operation display section 30, printer section 40, and post processing unit 60.

The printer controller 10 is structured being provided with a controller control section 11, DRAM control IC 12, image memory 13, communication control section 14, and NIC (Network Interface Card) 15.

The controller control section 11 totally controls each kind of operations and realizes a function by which, through the communication control section 14 and NIC 15, the output data such as the image data inputted from PCs (Personal Computer) 2 as the external device on LAN (Local Area Network) is distributed to the control means 100 as a job. As the external device, it is not limited to PCs 2, but may also be another kind of devices such as a PDA, another copier.

The communication network by which the PCs 2 and the copier 1 are communication connected is described as LAN, however, it is not limited to this, but it may also be a communication network such as other kinds of communication networks such as a WAN (Work Area Network), exclusive line, or in which they are combined.

DRAM control IC 12 controls the accommodation of the output data received by NIC 15, communication control section 14 in the image memory 13, or reading-out of the output data from the image memory 13. Further, DRAM control IC 12 is connected to the DRAM control IC 160 of the control means 100 through the PCI (Peripheral Component Interconnect) bus, and according to the indication from the controller control section 11, the output data which is an object to be image formed, is read-out from the image memory 13 and outputted to the DRAM control IC 160.

The image memory 13 is structured by DRAM, and temporarily accommodates the inputted output data.

The communication control section 14 controls the communication of NIC 15. NIC 15 is a communication interface for connecting to LAN, and through LAN from PCs 2, receives the output data of the print object. The received output data is outputted to the DRAM control IC 12.

The image reading section 20 is structured being provided an ADF section 21 shown in FIG. 1, and the scanner section 22 having a CCD (Charge Coupled Device) image sensor 23, an image reading control section 24, and an ADF control section 25. The image reading control section 24 controls the scanner section 22 and conducts the light-scanning of the document surface according to the indication from the image control section 110, and outputs the read-out analog image signal to the reading processing section 150 of the control section 100. The ADF control section 25 controls, according to the indication from the image control section 110, the ADF section 21, and sends the document to the contact glass of the scanner section 22 in order, and after the light-scanning, it is delivered.

The operation display section 30 is structured by a touch panel integrated with the LCD (Liquid Crystal Display) 31, each kinds of function keys, not shown, and the operation display control section 32. The operation display control section 32 outputs the operation signal operated by each kinds of function keys, or the touch panel to the image control section 110. Further, the operation display control section 32 displays each kind of operation image planes, each kind of processing results on the LCD 31.

The printer section 40 is structured being provided with each section according to the print such as the image forming section 42, and the printer control section 44. The printer control section 44 controls the operation of each section of the printer section 40, according to the indication from the image control section 110, and based on the image data inputted from a writing processing section 190, conducts the image formation of the recording sheet on the image forming section 42.

The post processing unit 60 is structured being provided with each kind of post processing sections which are not shown, and the post processing control section 61. The post processing control section 61 controls each kind of the post processing sections so that each kind of the post processing is conducted on the image formed recording sheet outputted from the printer section 40, according to the indication of the image control section 110.

The control means 100 is structured being provided with the image control section 110, program memory 120, system memory 130 as the memory means, non-volatile memory 140, reading processing section 150, DRAM (Dynamic Random Access Memory) control IC 160, image memory 170, compression·elongation IC 180, and writing control section 190.

The image processing section 110 is structured by CPUs (Central Processing Unit), and centralized-controls each section of the copier 1. The image control section 110 reads-out the indicated program from the system program accommodated in the program memory 120 and each kind of application programs, develops it in the system memory 130, and by the cooperation with the program developed in the system memory 130, controls each kind of processing.

Further, the image control section 110 composes the chapter title information for each chapter with the image data and creates the compounded image data, by the cooperation with the first image forming program which will be described later, and group-divides the composite image to the printer section 40 and image-forms on the recording sheet.

The program memory 120 is structured by ROM (Read Only Memory), and stores the system program, each kind of application programs, and each data. The program memory 120 stores the first image forming program for conducting the first image forming processing which will be described later.

The system memory 130 is structured by RAM (Random Access Memory), and has a work area storing each kind of data and each kind of programs. The system memory 130 has, for example, the first memory area, the second memory area, and stores the chapter title information in the first memory area, and stores the chapter number counter counting the chapter number and the whole page number counter counting the whole page number in the second memory area. The chapter title information is defined as the title set for each chapter, and includes at least the text other than the number.

The non-volatile memory 140 is structured by a flash memory, and stores each kind of data re-writably. It may also be structured in such a manner that the chapter number counter and the whole page number counter are stored in the non-volatile memory 140.

The reading processing section 150 conducts each processing such as the analog processing, A/D conversion processing, shading processing on the analog signal inputted from the image reading control section 24 of the image reading section 20 and generates the digital image data. The generated digital image data is outputted to the DRAM control IC 160.

The DRAM control IC 160 controls the compression processing of the digital image data, the elongation processing of the compression image data by the compression·elongation IC 180, according to the indication from the image control section 110, and conducts the input output control of the image data to the image memory 170. For example, when the storing of the read-out analog image data is indicated by the image reading section 20, it makes conduct the compression processing of the digital image data inputted from the reading processing section 150 by the compression·elongation IC 180, and makes accommodate the compression image data in the compression memory 171 of the image memory 170.

Further, when the image forming output of the compression image data accommodated in the compression memory 171 is indicated, the DRAM control IC 160 reads the compression image data from the compression memory 171, conducts the elongation processing by the compression·elongation IC 180, and makes accommodate in the page memory 172. Further, when the image forming output of the non-compression image data accommodated in the page memory 172 is indicated, it reads-out the non-compression image data and outputs it to the writing processing section 190.

The image memory 170 is structured being provided with the compression memory 171 such as DRAM, and page memory 172. The compression memory 171 is a memory for accommodating the compression image data. The page memory 172 is a memory for temporarily accommodating the non-compression image data which is the output object of the image formation before the output of the image formation.

The compression·elongation IC 180 conducts the compression processing on the image data inputted from the DRAM control IC 160 and generates the compression image data, and outputs to the DRAM control IC 160. Further, the compression·elongation IC 180 conducts the elongation processing on the compression image data inputted from the DRAM control IC 160, generates the non-compression image data and outputs to the DRAM control IC 160.

The writing processing section 190 generates the print data for the image formation, based on the non-compression image data inputted from the DRAM control IC 160, and outputs it to the printer section 40 (the image forming section 42).

Figure 3:
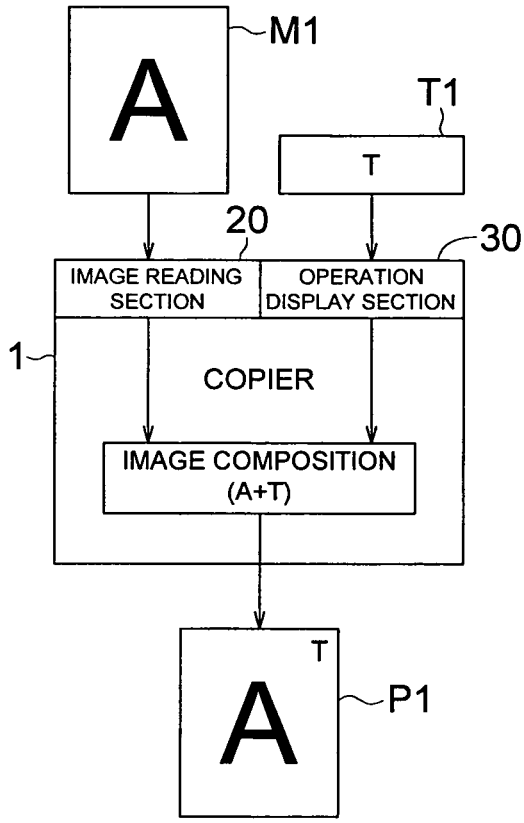
FIG. 3 is a view showing a flow from the input of a document M1 and a text string T1 to the output of the recording sheet P1.
Figure 4:
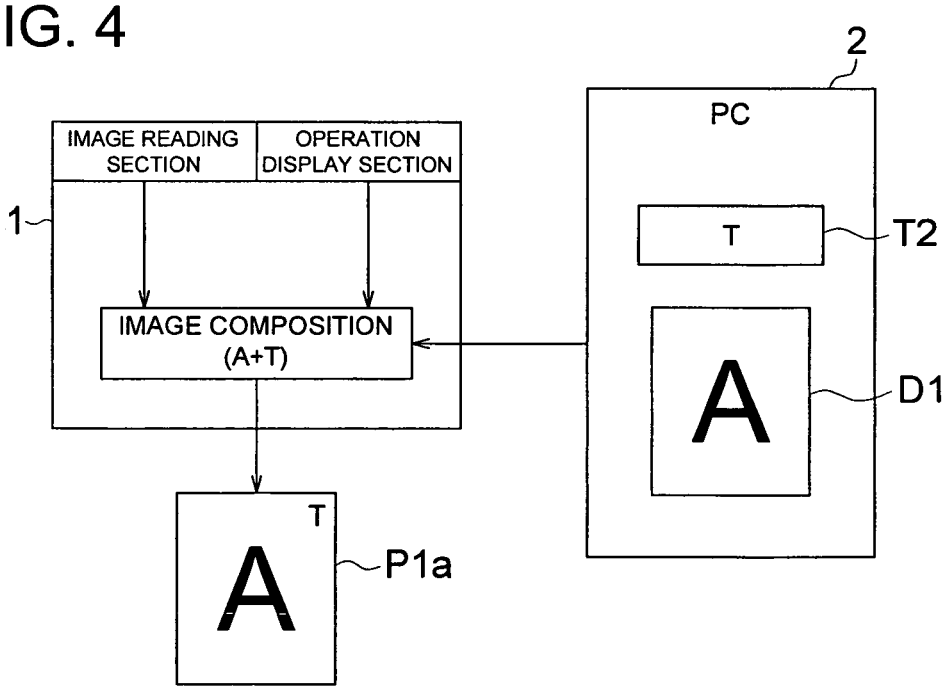
FIG. 4 is a view showing a flow from the input of the image data D1 and the text string T2 to the output of the recording sheet P1*a*.

Next, the operation of the copier 1 in the present embodiment will be described below. Initially, referring to FIG. 3 and FIG. 4, the input of the image data, and text string which is compounded to the image data as the image, and the output of the recording sheet will be described. In FIG. 3, a flow from the input of the document M1 and the text string T1 to the output of the recording sheet is shown. In FIG. 4, a flow from. the input of the image data D1 and the text string T2 to the output of the recording sheet P1*a* is shown.

As shown in FIG. 3, in the copier 1, the document M1 on which the image A is recorded, is read-out by the image reading section 20, and the image data of the image A is obtained. Further, through the operation display section 30, the text string T1 of the text (content) T which is operation-inputted by the user is obtained. Then, by the control means 100, the text string T1 is compounded as the image to the image data of the image A, and the compounded image data is chapter-divided by the printer section 40 and image-formed, and the recording sheet P1 is outputted. Hereupon, it is assumed that the image A is an arbitrary image, and the text T is a text including the letter except the number of the chapter number.

Further, from the external device, the image data and the text string may also be inputted. As shown in FIG. 4, the images data D1 of the image A stored in the memory section (not shown) of PC2 and the text string T2 of the text T stored in the memory section which is operation-inputted by the user through the operation section (not shown) are inputted into the copier 1 through LAN. Then, in the same manner as in FIG. 3, the image compound and group-dividing and image formation are conducted, and the recording sheet P1*a* is outputted. Further, PC2 may be creates the composite image, and sends the composite image to the copier 1.

Figure 5:
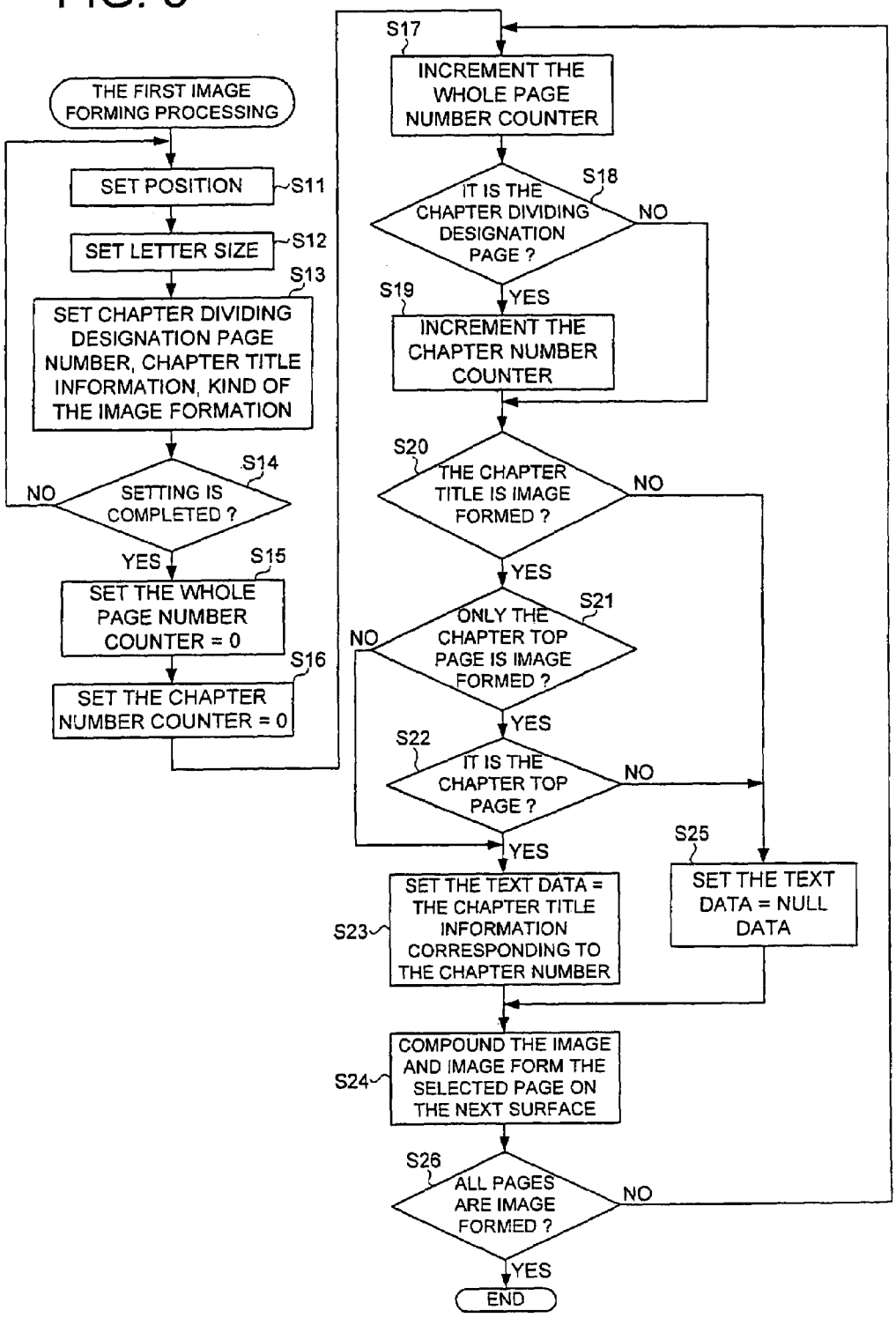
FIG. 5 is a flow chart showing the first image forming processing.
Figure 6:
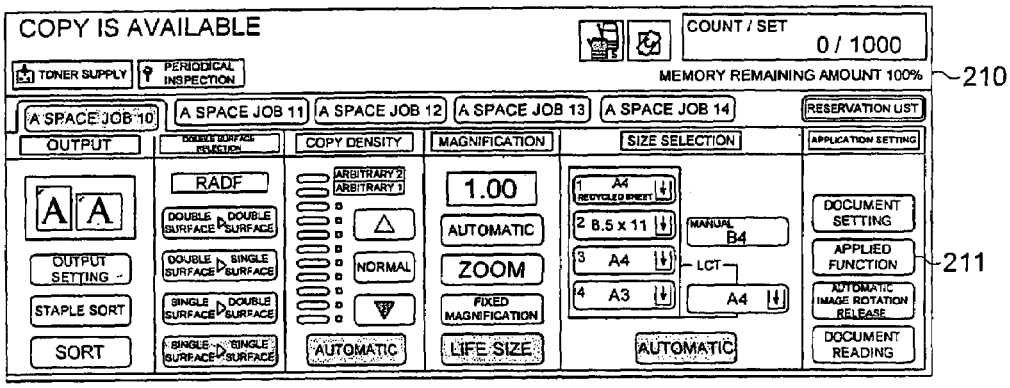
FIG. 6(*a*) is a view showing a structure of a main operation image plane 210.
Figure 6:
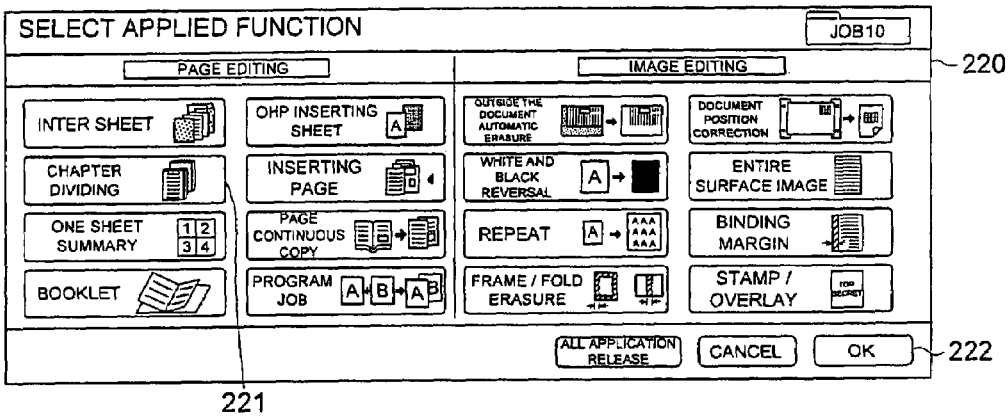
Figure 6:
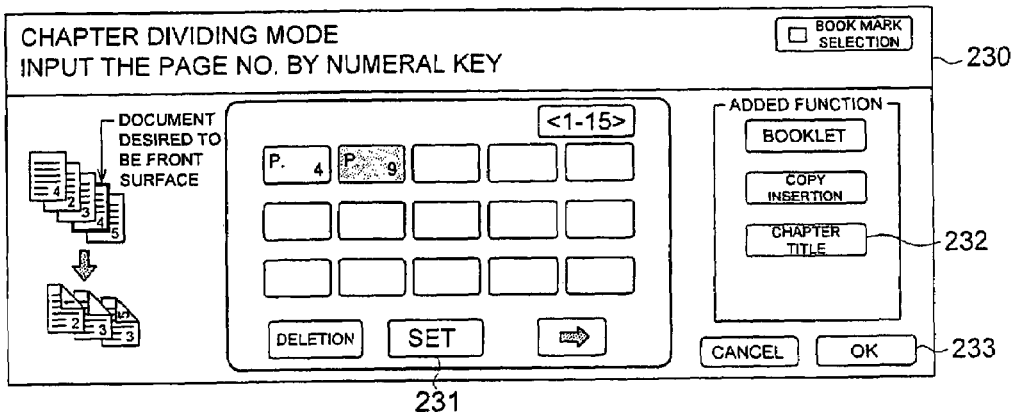
Figure 7:
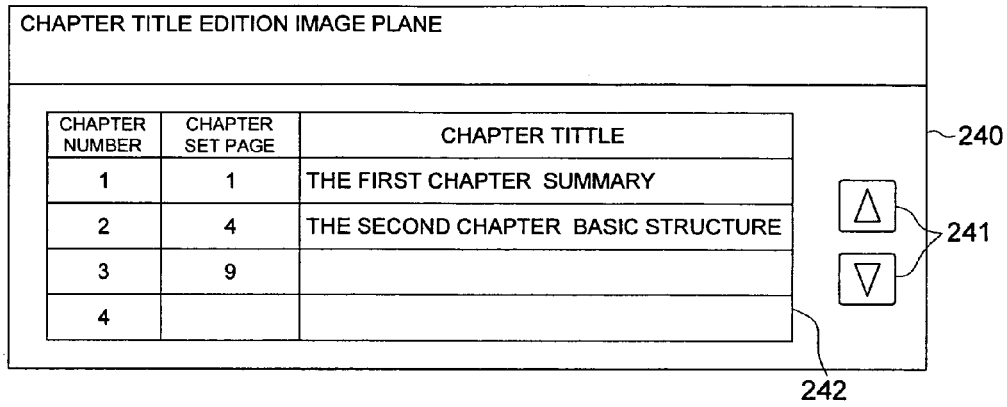
FIG. 7(*a*) is a view showing a chapter title information list display image plane 240.
Figure 7:
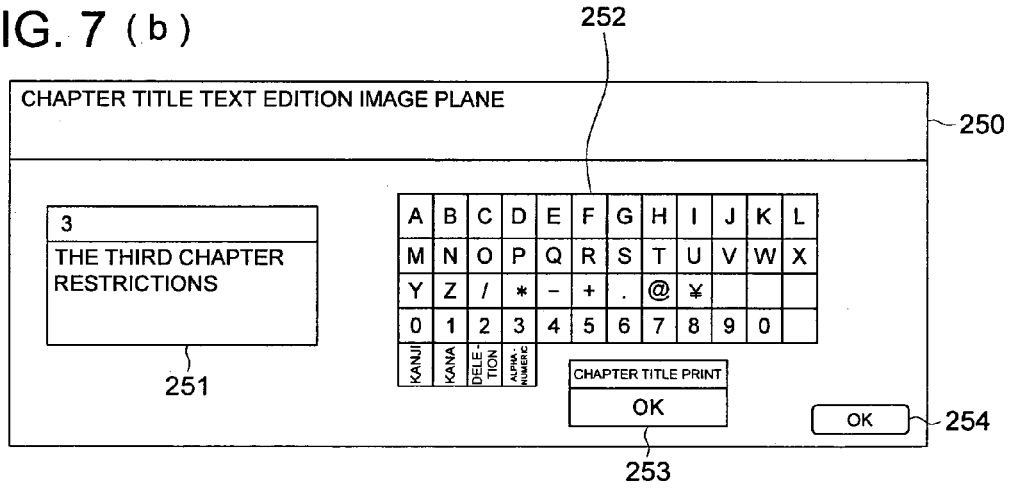
Figure 7:
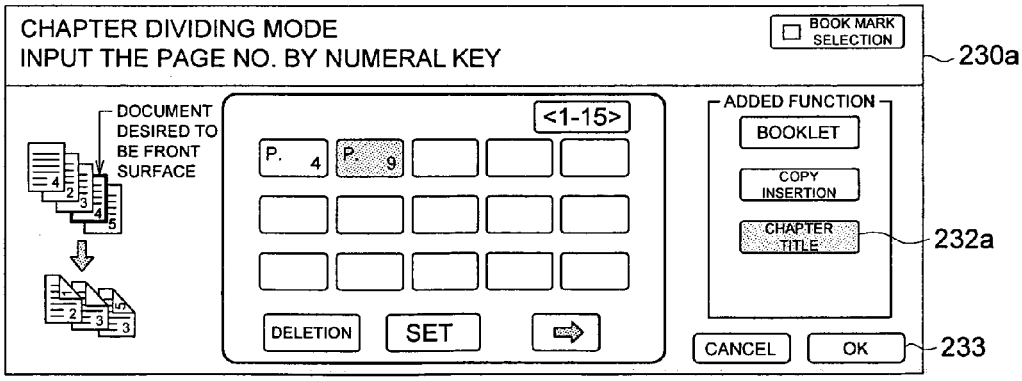

Next, referring to FIG. 5-FIG. 7, the first image forming processing conducted in the copier 1 will be described. In FIG. 5, a flow of the first image forming processing is shown. In FIG. 6(*a*), the structure of the main operation image plane 210 is shown. In FIG. 6(*b*), an applied function operation image plane 220 is shown. In FIG. 6(*c*), a chapter-dividing designation page number input image plane 230 is shown. In FIG. 7(*a*), a chapter title information list display image plane 240 is shown. In FIG. 7(*b*), a chapter title information input image plane 250 is shown. In FIG. 7(*c*), a chapter-dividing designation page number input image plane 230*a* is shown.

When the image data is image-formed on the recording sheet by the group-dividing function, the first image forming processing all-page-image forms the chapter title information of each chapter together with the image data. It is a processing by which it is selected that only the top page is image formed or it is not image formed, and image formed. For example, through the operation display section 30, it is made a trigger that the chapter-diving mode translation is inputted, and by the cooperation of the first image forming program which is read-out from the program memory 120 and developed in the system memory 130, and the image control section 110, the first image forming processing is conducted.

For example, when the main operation image plane 210 shown in FIG. 6(*a*) is displayed on the LCD 31, the applied function key 211 is touch-inputted by the user, the applied function operation image plane 220 shown in FIG. 6(*b*) is displayed on the LCD 31, and the chapter-dividing key 221 is touch-inputted by the user, the chapter-dividing mode is started, and the first image forming processing is conducted.

Initially, the image forming position information of the chapter title information on the recording sheet which is inputted by the user through the operation display section 30, is received, and based on the position information, the image forming position of the chapter title information is set (step S11). Then, the letter size information of the chapter title information which is inputted by the user through the operation display section 30, is received, and based on the letter size information, the letter size of the chapter title information is set (step S12).

Then, based on the chapter-dividing page number information which is the page number of top of inputted each chapter, the chapter title information of each chapter, and the kind of image formation, the chapter-dividing page number, the chapter title information, and the kind of the image formation, are set (step S13). The kind of the image formation is defined to be 3 kinds in which the chapter title is all-page image formed, the chapter title is image formed only on the chapter top page of each chapter, and the chapter title is not image formed.

In step S13, for example, as shown in FIG. 3, the chapter-dividing designation number information inputted by the user through the operation display section 30 and the chapter title information of each chapter and the kind of the image formation are received, and each information is set.

Specifically, the chapter-dividing designation page number input image plane 230 is displayed on LCD 31, based on the touch selection input of the chapter setting key 231 and the input of the numeral key as the hard key, the chapter-dividing page number is set. In this stage, because the setting relating to the chapter-dividing is not completed, the chapter title setting display section 232 is normally displayed. When OK key 233 is pressed in the chapter-dividing designation page number input image plane 230, the chapter title information list display image plane 240 is displayed on LCD 31, and based on the touch selection input of the chapter title information selection section 242, scroll-freely by the touch input of the scroll key 241, the chapter is selected in which the chapter title is newly inputted or edited.

Then, the chapter title information input image plane 250 shown in FIG. 7(*b*) is displayed on LCD 31, and the chapter title information is touch inputted by the letter input key 252, and the chapter title information is displayed on the chapter title information display section 251. Further, corresponding to respective cases of all-page image formation of the chapter title information of each chapter, image formation of only the chapter top page, or the image formation is not conducted, by the touch input of the chapter title setting section 253. (all-page) ON/(all-page) OFF/(only) the chapter top page, are switchingly inputted. When OK key 254 is pressed on the chapter title information input image plane 250, the chapter-dividing designation page number input image plane 230*a* is displayed on LCD 31. On the designation page number input image plane 230*a*, so that it is shown that the information setting relating to the chapter-dividing is completed, the chapter title setting display section 232*a* is reversely displayed. When OK key 233 is pressed on the chapter designation page number input image plane 230*a*, the applied function operation image plane 220 shown in FIG. 6(*b*)is displayed on LCD 31. When OK key 222 is pressed on the applied function operation image plane 220, the main operation image plane 210 shown in FIG. 6(*a*) is displayed on LCD 31.

Further, in step S13, as shown in FIG. 4, the chapter title information operation-inputted by PC2 may also be received from PC2 through the printer controller 10 and set. Furthermore, in addition to the chapter title information, the chapter-dividing page number information or the kind of image information may also be received from PC2 and set. The system memory 130 stores the chapter title information.

Then, it is discriminated whether each kind of setting by the input is completed (step S14). In step S14, for example, in the situation that the main operation image plane 210 shown in FIG. 6(*a*) is displayed on LCD 31, depending on a case whether the image formation execution button of the hard key of the operation display section 30 is pressed by the user, it is discriminated whether each kind of setting by the user is completed. When each kind of setting is not completed (step S14: NO), the sequence is advanced to step S11. When each kind of setting is completed (step S14: YES), the all-page number counter is set to 0, and stored in the system memory 130 (step S15) Then, the chapter number counter is set to 0, and stored in the system memory 130 (step S16) Then, the all-page number counter stored in the system memory 130 is incremented by 1 and set (step S17). In step S17, the page number is successively selected by 1 from the initial all-page number to the last page number in order. Then, the all-page number counter stored in the system memory 130 is referred, and it is discriminated whether the all-page number is the chapter-dividing designation page number (step S18). When it is the chapter-dividing designation page number (step S18: YES), the chapter number counter stored in the system memory 130 is incremented by 1, and set (step S19).

Then, based on the kind of the image formation set in step S13, it is discriminated whether the chapter title information is image formed (step S20). When the kind of the image formation is a case of the image formation of the all-page of the chapter title information or the image formation of only the chapter top page, it is discriminated that the chapter title information is image formed. When it is not the chapter-dividing designation page number (step S18: NO), the sequence is advanced-to step S20.

When the chapter title information is image formed (step S20: YES), based on the kind of image formation set in step S13, it is discriminated whether only the chapter top page is image formed (step S21). When only the chapter top page is image formed (step S21: YES), the all-page number counter stored in the system memory 130, is referred, and it is discriminated whether the all-page number is the chapter-dividing designation page number (the chapter top page number) set in step S13 (step S22).

When it is the chapter top page number (step S22: YES), the text string compounded to the image data is set to the chapter title information corresponding to the chapter number of the chapter number counter stored in the system memory 130 in the chapter title information inputted in step S13 (step S23). When the only the chapter top page is not image formed (step S21: NO), in order to image form the chapter title information on all pages, the sequence is advanced to step S23.

Then, to the input image data which will be image formed, in the position and the letter size set in steps S11, S12, the text string set in step S23 or step S25 is compounded as the image, and by the printer section 40, the composite image for 1 page is image formed on the next surface of the recording sheet (step S24). The next surface of the recording sheet is the surface of the next recording sheet in the chapter-dividing designation page, and in other cases, the next surface or rear surface of the image formed surface. Further, the input image data is, as shown in FIG. 3, the image data inputted by the reading by the image reading section 20, or the image data inputted by the signal receiving from P02 through the printer controller 10. Further, the composition means that the text string is compounded as the image in the area except the input image data, however, it is not limited to this, it may also be a structure in which the text string is compounded as the image in the area in the input image data.

When the chapter title information is not image formed (step S20: NO), or it is not the chapter top page number (step S22: NO), the text string which is compounded to the image data is set to NULL (there is no data) (step S25), the sequence is advanced to step S24. The text string of NULL is not practically image formed in step S24.

Then, by step S24, it is discriminated whether all pages are image formed (step S26). When all pages are not image formed (step S26: NO), the sequence is advanced to step S17. When all pages are image formed (step S26: YES), the first image forming-processing is ended.

Figure 8:
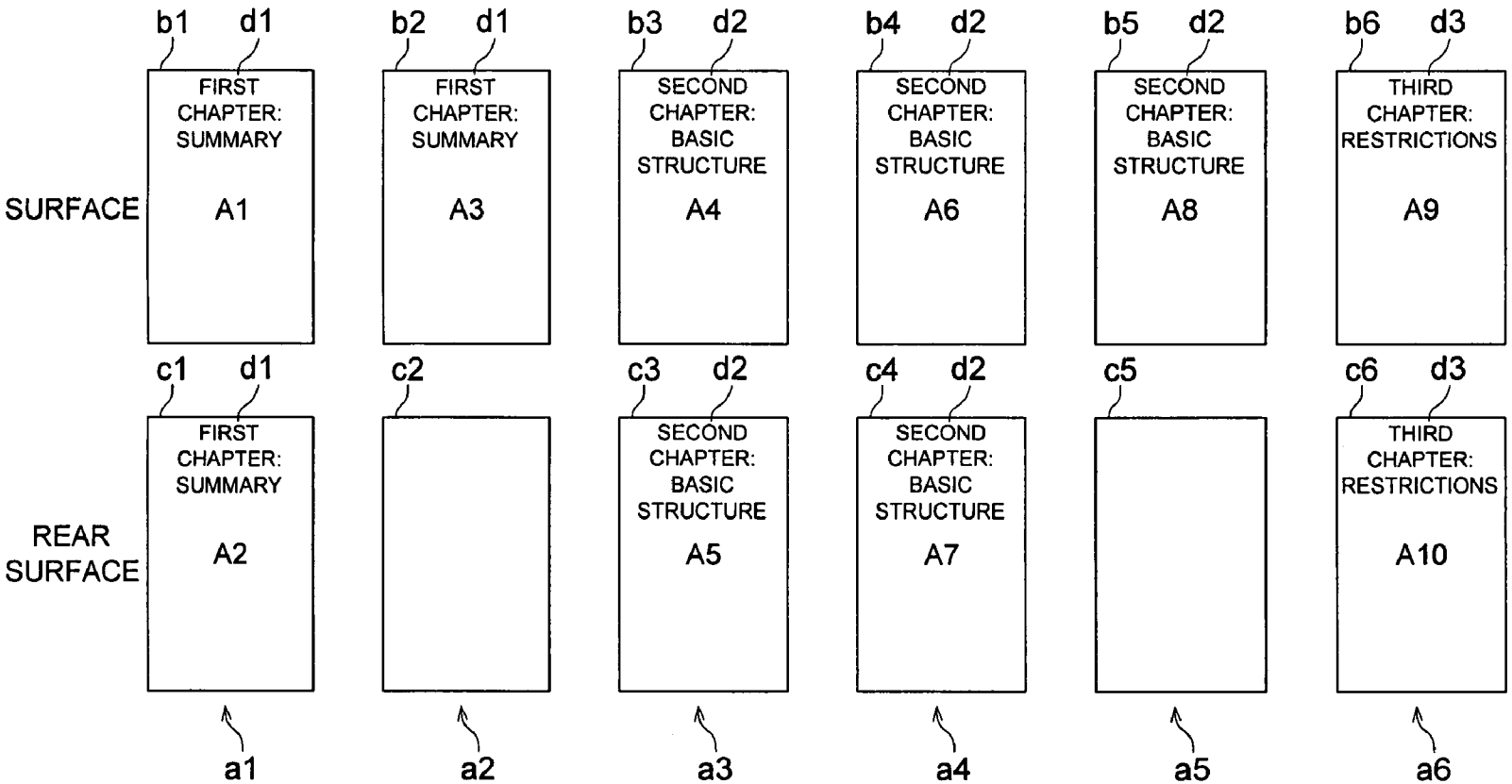
FIG. 8 is a view showing recording sheets a1-a6 on all pages of which, together with the image data, the chapter title information is image formed.
Figure 9:
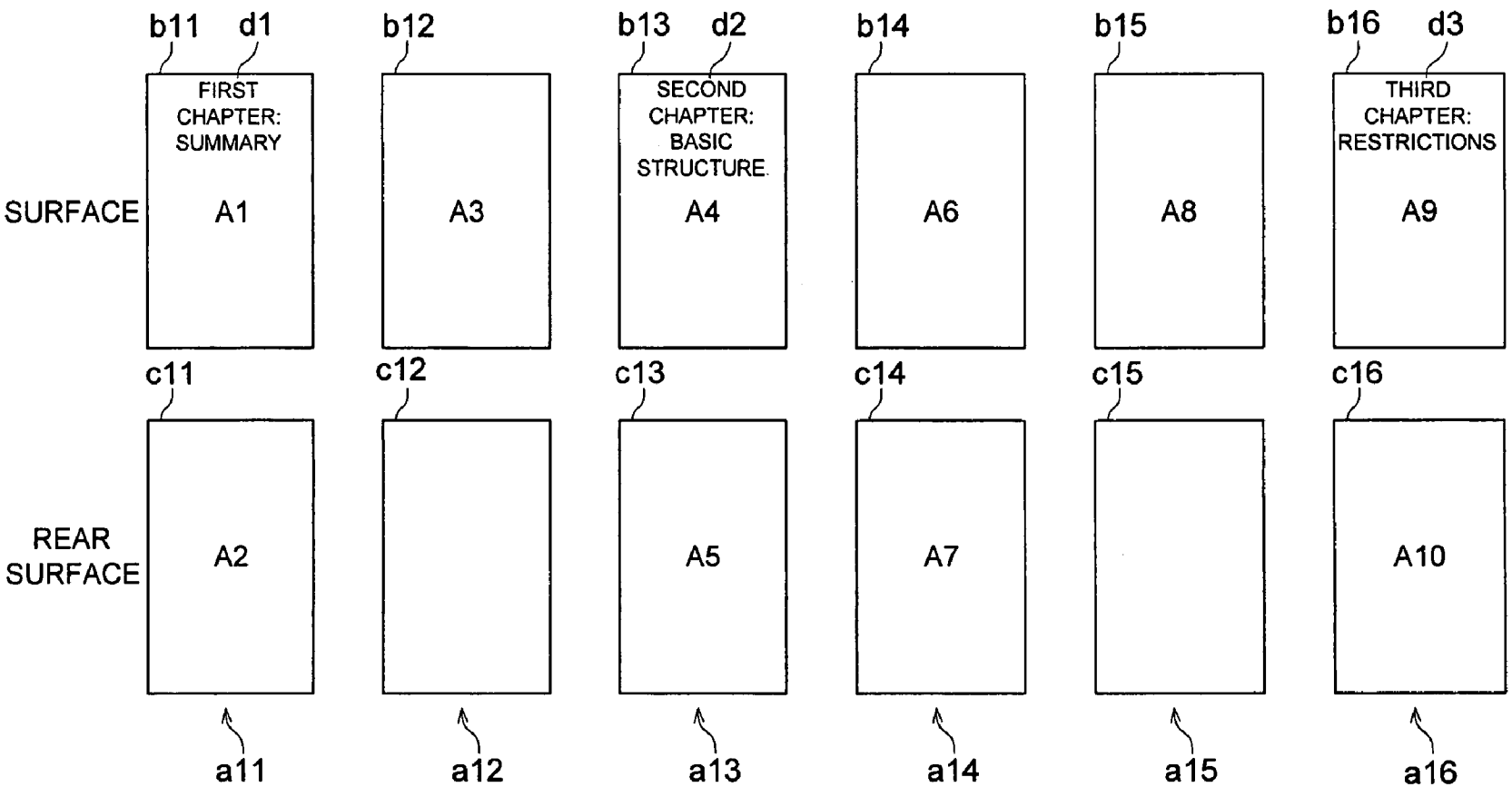
FIG. 9 is a view showing the recording sheets a11-a16 on which the chapter title information is image formed together with the image data on the chapter top page.

Next, referring to FIG. 8 and FIG. 9, the specific example of the image formation by the first image forming processing is shown. In FIG. 8, the recording sheets a1-a6 on whose all pages, together with the image data, the chapter title information is image formed, are shown. In FIG. 9, the recording sheets a11-a16 on whose chapter top page, together with the image data, the chapter title information is image formed, are shown.

The chapter-dividing in FIG. 8 and FIG. 9, is assumed that it corresponds to an example of FIG. 6(*c*). In the example in FIG. 6(*c*), the chapter top page of the first chapter is automatically set on the first page, in the same manner, the chapter top page is set as the forth page of the second chapter, the ninth page of the third chapter, that is, the chapter-dividing designation page number is set to 1, 4, 9.

Referring to FIG. 8, in step S13 of the first image forming processing, an example of a case where the kind of the image formation is set the all-page image formation of the chapter title, will be described. In the first chapter, in the recording sheet a1, the image data A1, the chapter title information d1 "the first chapter: abstract" is image formed on the surface b1, and on the rear surface c1, the image data A2, the chapter title information d1 is image formed. In the recording sheet a2, on the surface b2, the image data A3, the chapter title information d1 is image formed, and on the rear surface c2, the image data, the chapter title information is not image formed.

In the same manner, in the second chapter, in the recording sheets a3-a5, on the surface b3, the rear surface c3—the surface b5, the image data A4-A8, the chapter title information d2 "the second chapter: basic structure" are image formed in order, and on the rear surface c5, the image data, the chapter title information are not image formed. In the same manner, in the third chapter, in the recording sheet a6, on the surface b6, the rear surface c6, the image data A9, A10, the chapter title information d3 "the third chapter: restrictions" are image formed in order.

Referring to FIG. 9, an example of the case where the kind of image formation is set to the chapter top page image formation of the chapter title information in step S13 of the first image forming processing, will be described. In the first chapter, in the recording sheet all, on the surface b11, the image data A1, the chapter title information d1 are image formed, and on the rear surface c11, the image data A2 is image formed. In the recording sheet a12, on the surface b12, the image data A3 is image formed, and on the rear surface c12, the image data, the chapter title information are not image formed.

In the same manner, in the second chapter, in the recording sheets a13-a15, on the surface b13, the image data A4, the chapter tile information d2 are image formed, and on the rear surface c13--the surface b15, the image data A5-A8 are image formed in order, and on the rear surface c15, the image data, the chapter title information are not image formed. In the same manner, in the third chapter, in the recording sheet a16, on the surface b16, the image data A9, the chapter title information d3 are image formed, and on the rear surface c16, the image data Al0 is image formed.

As described above, according to the present embodiment, in the image formation in the group-dividing function, the chapter title information including the text except the numbers (the chapter number, the chapter page number) is compounded to the image data and can be image formed, and the recording sheet with high visibility can be outputted for each chapter.

Further, the page in which the chapter title data is compounded to the image data, can be selected from the chapter top page and all pages. As to this, when only the chapter top page is selected, on only the chapter top page, the chapter title information is compounded to the image data and can be image formed, and by the chapter title information, the chapter top page of the recording sheet can be visibly recognized. Further, the chapter title information is acquired by the signal receiving from PC2, and can be used for the image composition.

MODIFICATION EXAMPLE

Figure 10:
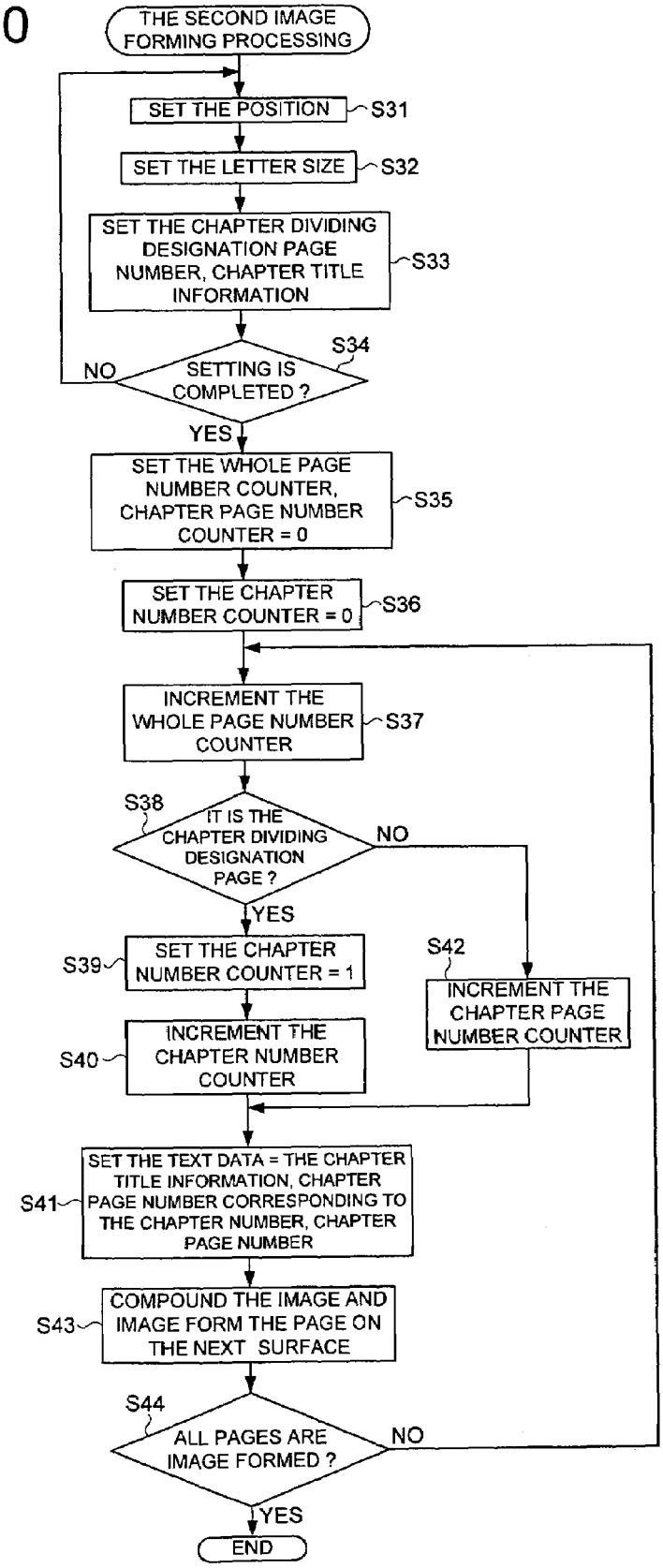
FIG. 10 is a flow chart showing the second image forming processing.
Figure 11:
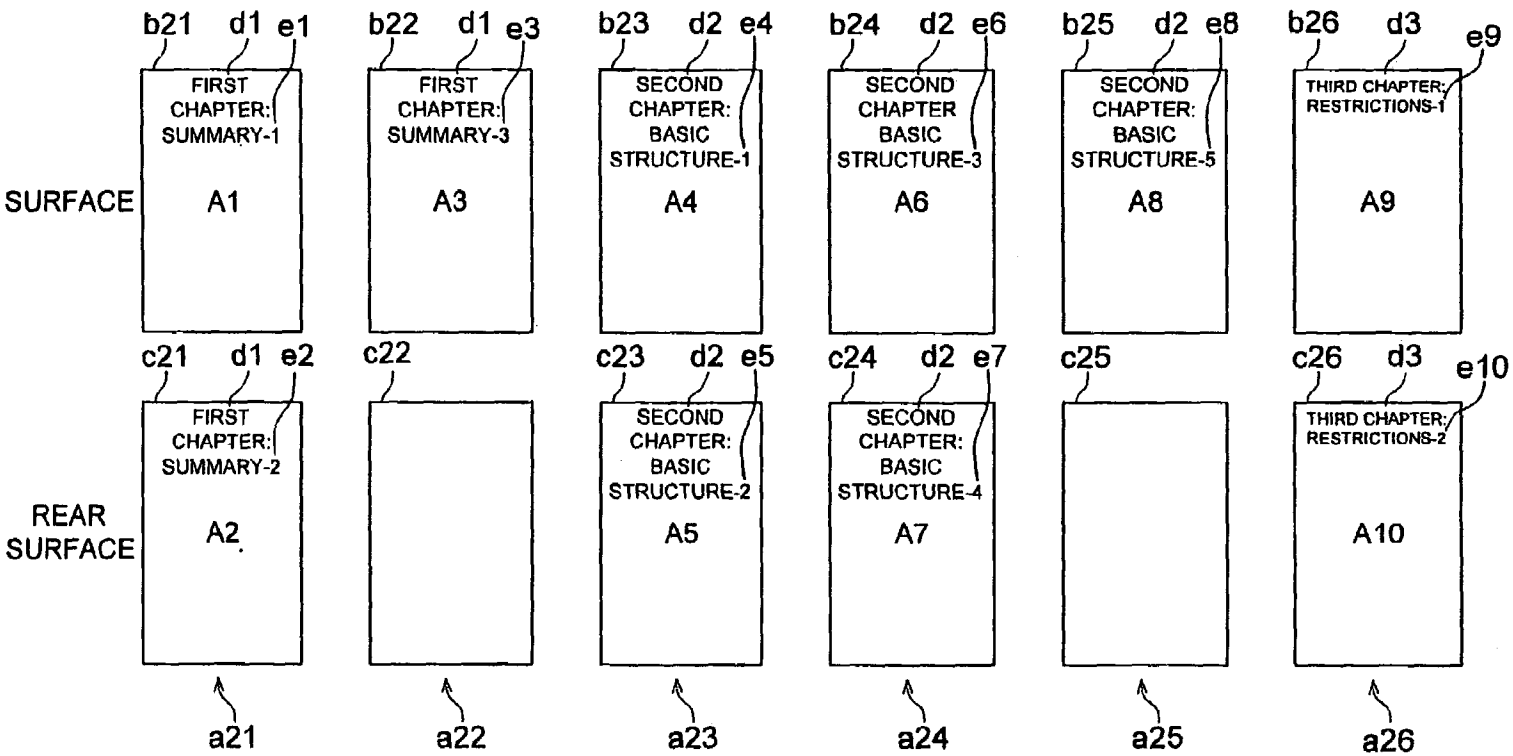
FIG. 11 is a view showing the recording sheets a21-a26 on the all pages of which the chapter title information and the chapter page information are image formed together with the image data.
Figure 12:
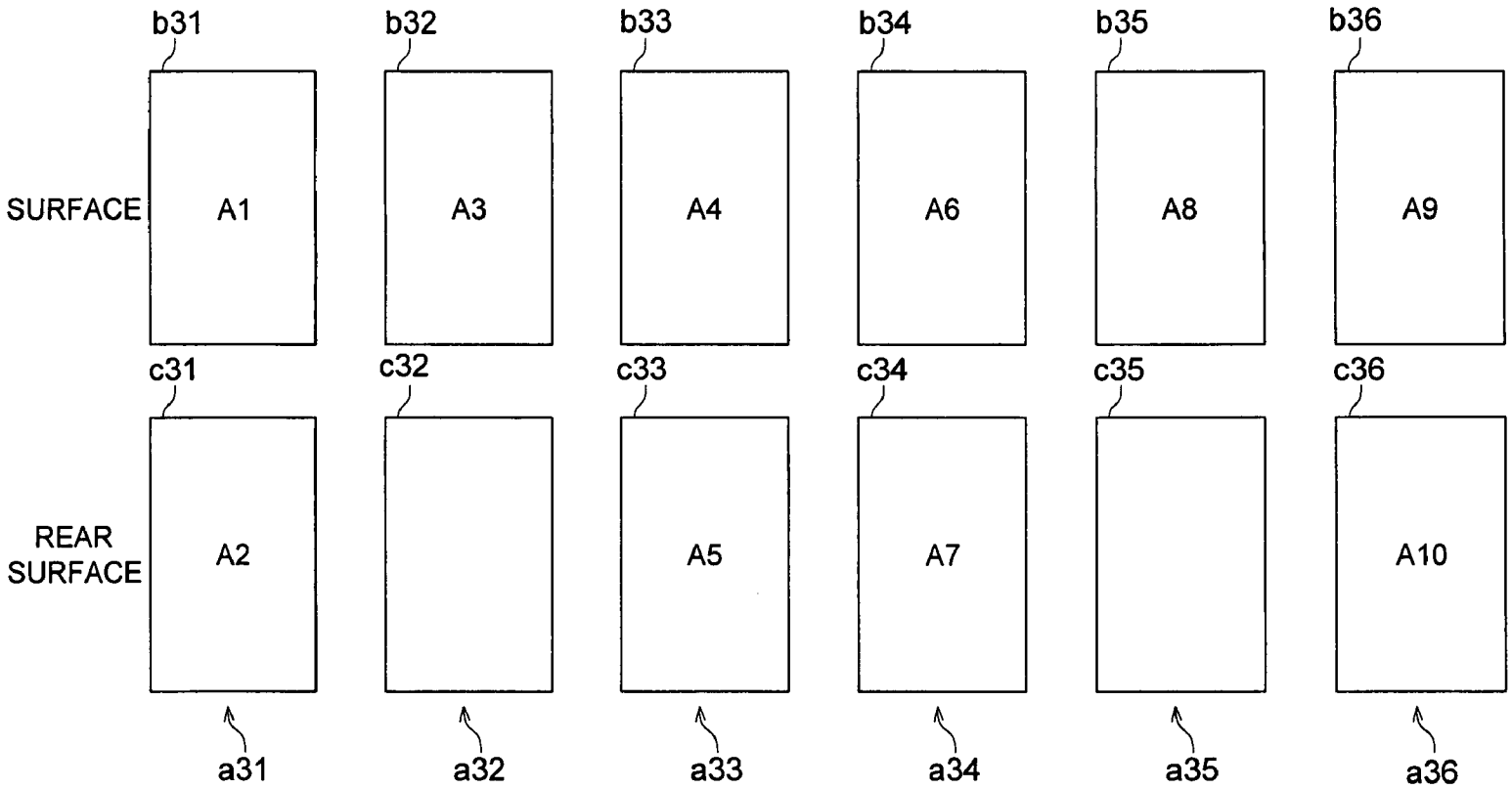
FIG. 12 is a view showing the recording sheets a31-a36 on which the image is formed by the group-dividing function.
Figure 13:
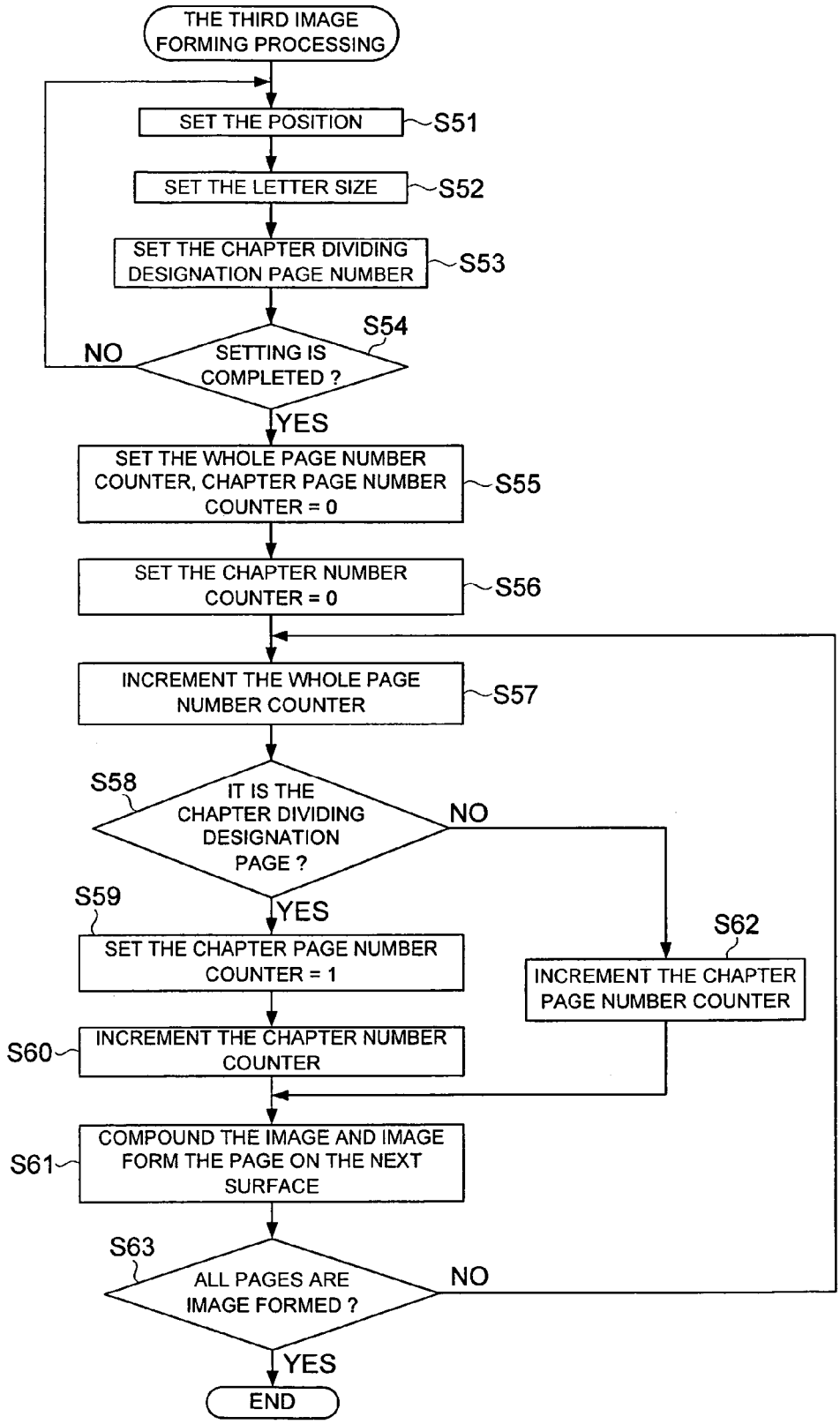
FIG. 13 is a flow chart showing the third image forming processing.
Figure 14:
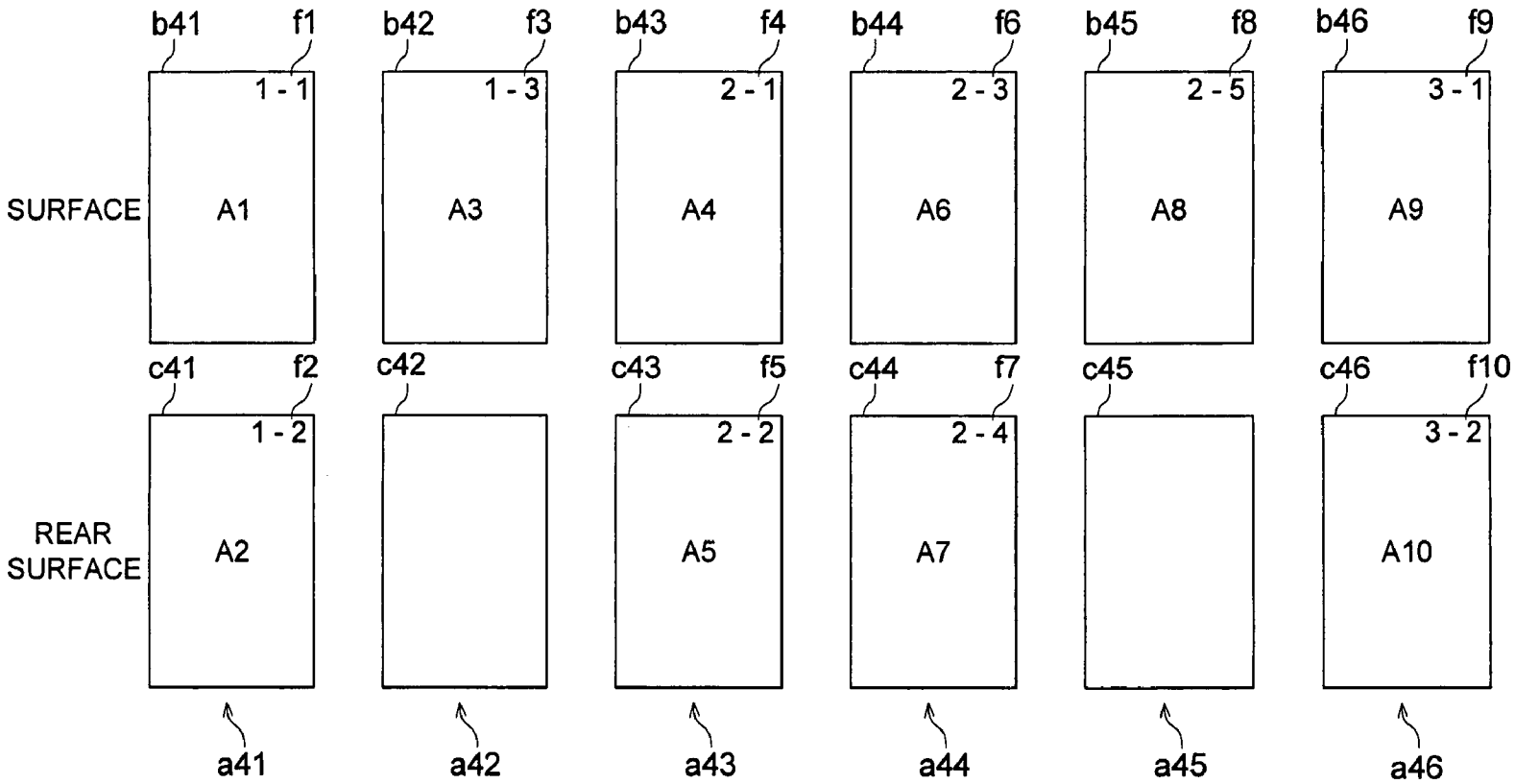
FIG. 14 is a view showing the recording sheets a41-a46 on which the chapter number and the chapter page number are images formed together with the image data.

Referring to FIG. 10 and FIG. 11, an example of modification of the above embodiment will be described. In FIG. 10, a flow of the second image forming processing is shown. In FIG. 11, the recording sheets a21-a26 on whose all pages, together with the image data, the chapter title information and the chapter page information are image formed, are shown.

The apparatus structure of the present modification example is assumed that it is the same as the above embodiment. However, in the program memory 120, the second image formation program for conducting the second image forming processing is stored. The system memory 130 stores the chapter number counter and the all-page number counter, and the chapter page number counter for counting the page number for each chapter. The chapter page number counter may also be structured in such a manner that it is stored in the non-volatile memory 140.

Next, referring to FIG. 10, the operation of the copier 1 in the present modification example, will be described. In the present modification example, the copier 1 conducts the second images forming processing.

When the image data is imaged formed by the group-dividing function on the recording sheet, the second image forming processing is the processing by which, together with the image data, the chapter title information of each chapter and the chapter page number are image formed on all pages. For example, through the operation display section 30, it is made a trigger that the execution indication of the second image forming processing is inputted, and by the cooperation of the second image formation program which is read from the program memory 120 and developed in the system memory 130, and the image control section 110, the second image forming processing is conducted.

Initially, steps S31, S32, are the same as steps S11, S12 of the image forming processing. Then, based on the operation display section 30, or the chapter-dividing page number information and the chapter title information of each chapter, inputted from PC2 through the printer controller 10, the chapter-dividing page number information and the chapter title information are set (step S33). Step S34 is the same as step S14 of the first image forming processing.

When each kind of settings is completed (step S34: YES), the all-page number counter, and the chapter page number counter showing the page number for each chapter are set to 0, and stored in the system memory 130 (step S35). Steps S36-S38 are the same as steps S16-S18 of the first image forming processing. When it is the chapter-dividing designation number (step S38: YES), the chapter page number counter stored in the system memory 130, is set to 1 (step S39). Step S40 is the same as step S19 of the first image forming processing.

Then, the text string compounded to the image data is set to the chapter title information corresponding to the chapter number of the chapter number counter stored in the system memory 130 in the chapter title information inputted in step S13, and the chapter page number of the chapter page number counter stored in the system memory 130 (step S41). When it is not the chapter-dividing designation page number (step S42: YES), the chapter page number counter stored in the system memory 130 is incremented by 1 and set (step S42), and advanced to step S41. Steps S43, S44 are the same as steps S24, S26 of the first image forming processing.

Next, referring to FIG. 11, a specific example of the image formation by the second image forming processing is shown. The chapter dividing in FIG. 11 corresponds to the example of FIG. 6(*c*), and the chapter-dividing designation page number is set to 1, 4, 9.

As shown in FIG. 11, in the first chapter, in the recording sheet a21, on the surface b21, the image data A1, the chapter title information d1 "the first chapter: abstract", the chapter page number el are image formed, and on the rear surface c21, the image data A2, the chapter title information d1, the chapter page number e2 are image formed. In the recording sheet a22, on the surface b22, the image data A3, the chapter title information d1, the chapter page number e3 are image formed, and on the rear surface c22, the image data, the chapter title information, and the chapter page number are not image formed.

In the same manner, in the second chapter, in the recording sheets a23-a25, on the surface b23, rear surface c23-b25, the image data A4-A8, the chapter title information d2 "the second chapter: basic structure", the chapter page numbers e4-e8 are image formed in order, and on the rear surface c25, the image data, the chapter title information, the chapter page number are not image formed. In the same manner, in the third chapter, in the recording sheet a26, on the surface b26, the rear surface c26, the image data A9, A10, the chapter title information d3 "the third chapter: restrictions", the chapter page numbers e9, e10 are image formed in order.

As described above, according to the present modification example, in the image formation in the group-dividing function, to the image data, the chapter title information including the text except the number, and the chapter page number are compounded and can be image formed, and the recording sheet having high visibility can be outputted for each chapter, and for each page of the chapter.

Hereupon, the description in the above embodiment and the modification example, is an example of the appropriate image forming apparatus according to the present invention, and not limited to this.

For example, in the above embodiment, the structure in which, together with the image data, the chapter title information including the text-except the number is the text string, is applied, however, it is not limited to this, the structure in which it is arbitrary text string including the text except the number, may also be applied. Further, in the above embodiment and the modification example, the structure in which the chapter title information is stored in the system memory 130, is applied, however, the structure in which it is stored in the non-volatile memory 140, and in the image formation of the chapter-diving after that, the chapter title information read from the non-volatile memory 140 is used, may also be adopted.

Further, in the above modification example, the structure in which, together with the image data, the chapter title information including the text except the number and the chapter page number are combined, and the text string is made, is adopted, however, it is not limited to this, and the structure in which an arbitrary text is combined with at least one of the chapter number, the chapter page number, and all-page number, and the text string is formed, may also be allowed. Further, the number combined with an arbitrary text may also be the number except the chapter number, the chapter page number, Further, in the embodiment and the modification example, as for the detailed structure of each section of the apparatus constituting the copier 1, and the detailed operation, they can be appropriately changed in the scope without departing from the sprit of the present invention.

According to the structure of the invention is capable creating the composite image of a page image and a text string which is inputted for the group including the page, and the recording sheet having the high visibility can be outputted for each group.

Further, the structure of the invention is capable creating the composite image for only the first page of each group, and the first page can be visibly recognized by the image formed text string.

Further, the structure of the invention is capable selecting the mode, which creating the composite image for the first page of each group or for the all pages.

Further, the structure of the invention is capable forming the text string as a watermark on the composite image.

Further, the structure of the invention is capable creating the composite image of the page image, the text string and number, wherein the number is incremented every page for each group.

Further, the structure of the invention is capable creating the composite image of the page image and the text string which is stored the memory, and the recording medium having the high visibility can be outputted for each page of the group.

What is claimed is:

1. An image forming apparatus comprising:

a dividing section which divides a plurality of pages into groups, each group including at least one page;

an inputting section which inputs different text strings for each group;

a creating section which creates a composite image of an image of a page and a text string which is inputted for the group including the page; and a printing section which prints the composite image on a sheet.

2. The image forming apparatus of claim 1, wherein the creating section creates the composite image for only the first page of each group.

3. The image forming apparatus of claim 1, wherein the creating section creates the composite image for all pages.

4. The image forming apparatus of claim 1, wherein the creating section has a first mode, in which the creating section creates the composite image for only the first page of each group, and a second mode, in which the creating section creates the composite image for all pages; and wherein the image forming apparatus, further comprises a selector which selects one of the first mode and the second mode.

5. The image forming apparatus of claim 1, wherein the text string is inputted by an operation panel.

6. The image forming apparatus of claim 1, wherein a plurality of images of pages and the text string are inputted from an external device via a network.

7. The image forming apparatus of claim 1, further comprising an image scanning section which scans a plurality pages of documents, wherein the creating section creates a composite image of a scanned page image and the corresponding text string.

8. The image forming apparatus of claim 1, wherein the creating section forms the text string as a watermark on the composite image.

9. The image forming apparatus of claim 1, wherein the creating section creates the composite image of the image of the page, the text string and a number, wherein the number is incremented every page for each group.

10. An image forming apparatus comprising:

a dividing section which divides a plurality of pages into groups, each group including at least one page;

a memory which stores different text strings for different groups;

a creating section which creates a composite image of an image of a page and the text string which is stored on the memory for the group including the page; and a printing section which prints the composite image on a sheet.

11. The image forming apparatus of claim 10, wherein the creating section creates the composite image for only the first page of each group.

12. The image forming apparatus of claim 10, wherein the creating section creates the composite image for all pages.

13. The image forming apparatus of claim 10, wherein the creating section has a first mode, in which the creating section creates the composite image for only the first page of each group, and a second mode, in which the creating section creates the composite image for all pages; and wherein the image forming apparatus, further comprises a selector which selects one of the first mode and the second mode.

14. The image forming apparatus of claim 10, further comprising an image scanning section which scans a plurality pages of documents, wherein the creating section creates a composite image of a scanned page image and the corresponding text string.

15. The image forming apparatus of claim 10, wherein the creating section forms the text string as a watermark on the composite image.

16. The image forming apparatus of claim 10, wherein the creating section creates the composite image of the page image of the page, the text string and a number, wherein the number is incremented every page for each group.

17. An image forming method comprising dividing a plurality of pages into groups, each group including at least one page;

inputting different text strings for each group;

creating a composite image of an image of a page and a text string which is inputted for the group including the page; and printing the composite image on a sheet.

18. The image forming method of claim 17, wherein the composite image is created for only the first page of each group.

19. The image forming method of claim 17, wherein the composite image is created for all pages.

20. The image forming method of claim 17, further comprising selecting one of a first mode and a second mode, wherein the first mode comprises creating the composite image for only the first page of each group, and the second mode comprises creating the composite image for all pages.

* * * * *